United States Patent [19]

Houston

[11] 4,170,180

[45] Oct. 9, 1979

[54] PEDESTAL WEAR LINER ASSEMBLY

[76] Inventor: Stanley M. Houston, 74 Scenic Dr., Orinda, Calif. 94563

[21] Appl. No.: 849,423

[22] Filed: Nov. 7, 1977

[51] Int. Cl.[2] ..... B61F 5/30; B61F 5/50; B61F 17/36; F16C 33/20

[52] U.S. Cl. ..... 105/225; 16/2; 85/50 R; 105/221 R; 308/238

[58] Field of Search ..... 16/2; 85/50 R; 105/225, 105/221 R; 308/238

[56] References Cited

U.S. PATENT DOCUMENTS

| | | | |
|---|---|---|---|
| 1,903,859 | 4/1933 | Glascodine | 105/225 |
| 2,275,315 | 3/1942 | Ray | 85/50 R |
| 2,319,920 | 5/1943 | Dohe et al. | 105/225 |
| 2,474,008 | 6/1949 | Meyer | 105/225 |
| 3,554,618 | 1/1971 | Ditzler et al. | 105/225 |
| 4,001,124 | 1/1977 | Hussey | 105/225 |
| 4,094,253 | 6/1978 | Gage | 105/225 |

*Primary Examiner*—Trygve M. Blix
*Assistant Examiner*—Howard Beltran
*Attorney, Agent, or Firm*—Joseph L. Strabala

[57] ABSTRACT

A pedestal assembly for use in a railroad vehicle having a journal box which slides vertically with respect to the pedestal assembly, said assembly including a pedestal liner consisting of elastomer having a wear face and a non-wear face, said wear face confronting the journal box, a pedestal liner insert consisting of an elastomer having a first and second side, the first side confronting the non-wear face of the pedestal liner and the second side confronting the pedestal leg, a plurality of spacing washers and a means attaching said pedestal liner and pedestal liner insert to said pedestal leg through said spacing washers and a process for producing the pedestal liner and the pedestal liner insert by injection molding.

5 Claims, 4 Drawing Figures

PEDESTAL WEAR LINER ASSEMBLY

BACKGROUND OF THE INVENTION

The present invention relates to improvements in trucks for railroad vehicles, especially locomotives. More particularly, the invention relates to improved bearing surfaces for those portions of the trucks which are slidably engaged to enable the wheels and the body of the vehicle to move relative to each other in a generally vertical direction.

The truck upon which the vehicle is supported comprises two side frames tied together by a transverse member called a bolster. One type of truck commonly used for locomotives is referred to as a pedestal truck. The pedestals are part of the side frames and are formed in inverted U-shaped sections that horizontally position and hold a journal box to move essentially vertically in relationship to the truck. The two projections that comprise the U of the pedestal are called the pedestal legs and the space between them the jaw. The jaw is closed at the bottom when the journal is inserted by means of a pedestal tie bar. In this manner, the journal box is held positioned in vertical sliding relationship with the truck. As the locomotive body is supported by the bolster and side frames, vertical movement between the locomotive body and the journal box, journal and wheels is permitted.

Considerable wear takes place at the interface between the pedestal and the journal box. Wear plates are attached to both the pedestal legs and journal boxes to reduce wear and protect the underlying parts. The wear plates attached to the pedestal legs are often referred to as pedestal liners and are the subject of the present invention. Qriginally the pedestal liners were made of steel, but more recently they have been made from nylon.

A pedestal liner now in use is produced as a monolithic nylon casting and is produced by known injection molding techniques. The castings are considerably more expensive to produce than injection molded parts, and further this monolithic casting has minimal shock absorbing properties. No spacing washers are employed, and when the coast pedestal liner is installed, the nylon will cold flow due to excess compressive forces causing it to move away from the pedestal leg. This results in relatively poor fit when the pedestal liner is attached to the pedestal leg, as there is a space of about one-sixteenth of an inch between the pedestal liner and the pedestal leg which causes extra wear and results in a shorter working life for the pedestal liner. It is believed impact abrasion occurs on the surface of the liner, leading to increased clearance and subsequent failure.

U.S. Pat. No. 3,554,618 to Ditzler et al discloses a two piece pedestal liner assembly. Although the pedestal liner assembly is produced in two pieces, the assembly has minimal shock absorbing properties since there is only one piece in the wear surface area. No spacing washers are disclosed, and the problems of poor fit discussed above are applicable to this pedestal liner.

SUMMARY OF THE INVENTION

It is an object of the present invention to produce a pedestal liner assembly which may be manufactured using injection molding techniques for the separate elastomer parts.

Another object of the present invention is the production of a two-piece pedestal liner assembly having good shock absorbing properties, which will reduce the amount of wear on the pedestal liner assembly.

Another object of the present invention is the production of a pedestal liner assembly with a polyurethane or other elastomer pedestal liner insert having improved shock absorbing properties relative to nylon.

Another object of the present invention is the production of a pedestal liner assembly having spacing washers which function as a bearing for both the nylon pedestal liner and the means attaching the pedestal liner and pedestal liner insert to the pedestal leg. The spacing washers also give the pedestal liner a better fit to the pedestal leg, reducing the gap of about one-sixteenth of an inch between the pedestal liner and the pedestal leg. The reduced gap increases the working life of the pedestal liner assembly by reducing the wear associated with the poor fit of the pedestal liner to the pedestal leg. The spacing washers also prevent unusually high loading on the mounting cheeks of the pedestal liner resulting from excess compression by the means attaching the pedestal liner to the pedestal leg. The excess compressive forces in the absence of a spacing washer are relieved by cold flow of the elastomer which distorts the pedestal liner and contribute to stress build-up which can cause the liner to crack.

Still another object of the present invention is the production of a pedestal liner assembly having a separate pedestal liner insert which may be changed to vary the physical characteristics of the pedestal liner assembly. By varying the physical characteristics of the pedestal liner assembly, the pedestal liner assembly may be customized to specific types of locomotives and their operating requirements.

These and other objects of the present invention will become apparent from the description and claims which follow.

BRIEF DESCRIPTION OF THE DRAWINGS

In order to more completely describe the invention, reference is made to the accompanying drawings.

DETAILED DESCRIPTION OF THE INVENTION AND DRAWINGS

Figure 1:
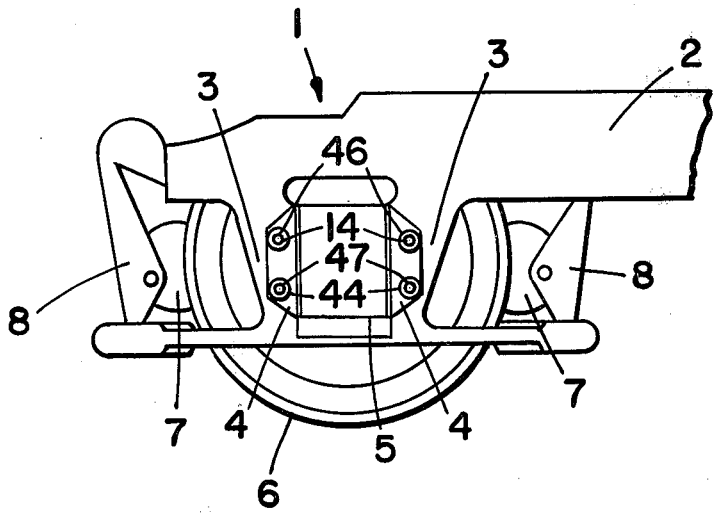
FIG. 1 is a side view, partially broken away, of the side frame of a pedestal truck, illustrating the pedestal liner assembly according to the present invention.

Referring to FIG. 1, there is illustrated a railroad truck of the pedestal type having a side frame 2 and pedestal legs 3. (Attached to the pedestal legs 3 are the assembled pedestal liners 4 according to this invention.) The pedestal liners 4 define the inner surface of the pedestal legs of the side frame 2. The pedestal legs 2 are designed to receive the journal box 5 which has a vertical sliding relationship with the pedestal legs. Also shown are a wheel 6, a pair of brake shoes 7, and a brake linkage 8, which form no part of the invention, and therefore no further description will be given of them. The pedestal liners 4 are attached to the pedestal legs 3 by a first bolt 46 passing through a first spacing washer 14 and a second bolt 47 passing through a third spacing washer 44.

Figure 3:
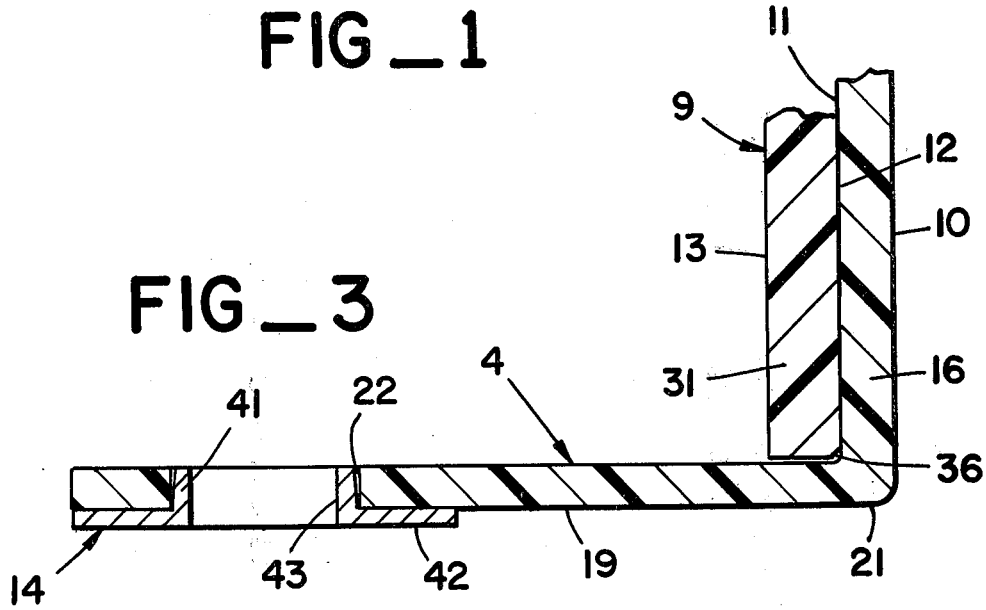
FIG. 3 is an enlarged view, partially broken away, illustrating a cross section of the pedestal liner, pedestal liner insert and first spacing washer taken through the center of the first spacing washer according to the present invention.
Figure 4:
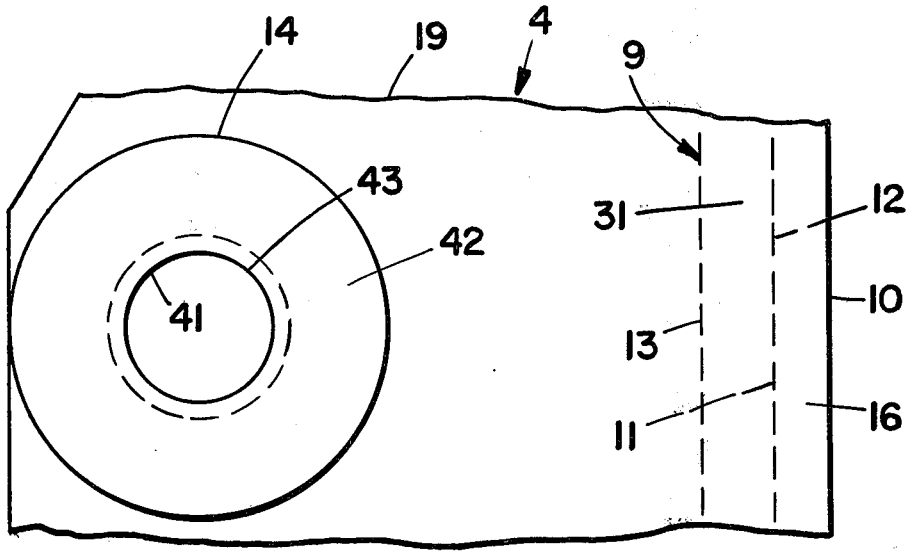
FIG. 4 is an enlarged view, partially broken away, illustrating the side of the pedestal liner, the pedestal liner insert and first spacing washer according to the present invention.
Figure 2:
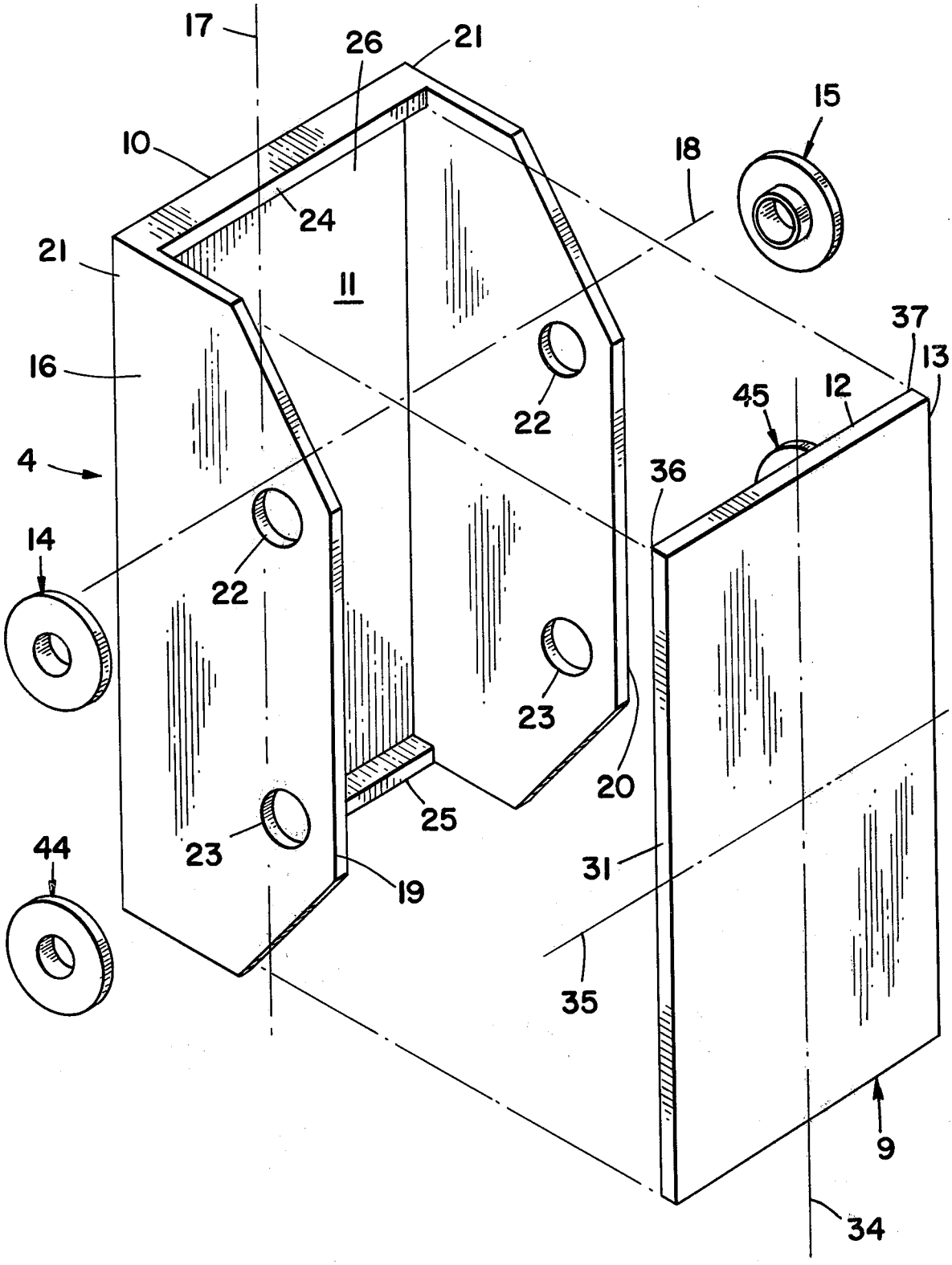
FIG. 2 is an enlarged perspective view illustrating a pedestal liner, a pedestal liner insert and the spacing washers according to the present invention.

Referring now to FIGS. 2, 3, and 4, there are illustrated the pedestal liner 4, a pedestal liner insert 9, the first spacing washer 14, a second spacing washer 15, the third spacing washer 44 and a fourth spacing washer 45.

The pedestal liner 4 has a rectangular planar liner element 16 having a wear face 10 and a non-wear face 11. The wear face 10 is planar and confronts and slides vertically with respect to the journal box (not shown). The non-wear face 11 is planar and parallel to the wear face 10 and on the opposite side of the liner element 16 as the wear face 10. The non-wear face 11 confronts the pedestal liner insert 9. The pedestal liner insert 9 and the pedestal liner 4 together form a shock absorbing component. The liner element 16 has a long axis 17 and a short axis 18. The liner element 16 has a first mounting bracket 19 and a second mounting bracket 20. The first 19 and second 20 mounting brackets are located along each edge 21 of the long axis 17 of the liner element 16, being perpendicular to the liner element 16, parallel to the long axis 17 of the liner element 16 and each other and extending behind the non-wear face 11 of the liner element 16. The first 19 and second 20 mounting brackets have a first hole 22 for receiving a first spacing washer 14 in the first mounting bracket 19, a first hole 22 for receiving a second spacing washer 15 in the second mounting bracket 20, and second hole 23 for receiving a third spacing washer 44 in the first mounting bracket 19, and a second hole 23 for receiving a fourth spacing washer 45 in the second mounting bracket 20. The liner element 16 has a first insert flange 24 and a second insert flange 26 located along each edge of the short axis 18 of the liner element 16. The first 24 and second 25 insert flanges are perpendicular to the liner element 16, parallel to the short axis 18 of the liner element 16 and each other and extend behind the non-wear face 11 of the liner element 16. The non-wear face 11 of the liner element 16, the first 19 and second 20 mounting brackets and the first 24 and second 25 insert flanges form a cavity for receiving the pedestal liner insert 9.

The pedestal liner insert 9 has a rectangular planar insert element 31 having a first 12 and second 13 sides. The first side 12 is planar and confronts the nonwear face 11 of the pedestal liner 4. The second side 13 is planar and confronts the pedestal leg 3. The second side 13 is the opposite surface of the insert element 31 as the first side 12. The insert element 31 has a long axis 34 and a short axis 35. The insert element 31 has a first beveled edge 36 and a second beveled edge 37 located along each edge of the long axis 34 of the insert element 31 on the first side 12. The beveled edges 36 and 37 face the cavity 26. The pedestal liner insert 9 conforms to the cavity 26 in the pedestal liner 4.

The spacing washers, 14, 15, 44 and 45, have an open cylinder 41 having an annular flange 42 at one end of the cylinder 41. The cylinder 41 has a hole 43 passing through its center which accommodates the means attaching the pedestal liner 4 and pedestal liner insert 9 to the pedestal leg 3. The hole 43 is larger than required for passage of the means attaching the pedestal liner 4 and pedestal liner insert 9 to allow adjustment of the pedestal liner 4 on the pedestal leg 3. The outer diameter of the cylinder is slightly smaller than the holes 22 and 23 in the mounting brackets 19 and 20 through which it passes. The cylinder is about the same length as the thickness of the mounting brackets 19 and 20. The cylinder 41 is of sufficient strength to act as a bearing for the pedestal liner 4 to the pedestal leg 3. The annular flange 42 supports the sides of the mounting brackets 19 and 20 and protects the mounting brackets 19 and 20 from the total compressive forces of the means attaching the pedestal liner 4 to the pedestal leg 3.

In a working embodiment of the present invention, the pedestal liner assembly has the following overall dimensions: length 14.875 plus or minus 0.030 inches, width 7.540 plus 0.020 or minus 0.015 inches, and height 5.50 plus or minus 0.030 inches. The length and width of the pedestal liner assembly define the wear face of the liner element which is 0.375 plus 0.010 or minus 0.005 inches in thickness. The length and height define the overall size of the mounting brackets, which are 0.250 plus 0.000 or minus 0.015 inches in thickness, have two holes 1.250 in diameter drilled after molding 6.50 inches apart with their center about 1.25 inches from the outer edge (edge away from liner element), and have their outer corners clipped, removing a right triangular element from each of the outer corners with a long side about 3.5 inches along the length of the bracket and a short side about 2.5 inches along the height of the bracket, the third side being the hypotenuse and the original outer corners forming the right angles of the triangles. The insert flanges run the width of the pedestal liner assembly, are 0.875 plus 0.005 or minus 0.030 inches in height and 0.375 plus or minus 0.010 inches in thickness. The cavity formed within the pedestal liner for receiving the pedestal liner insert is 14.125 plus 0.005 or minus 0.000 inches in length, 7.040 plus 0.005 or minus 0.000 inches in width and about 0.500 inches in depth. All corners are rounded with a radius of approximately 0.25 inch.

The pedestal liner insert is 14.125 plus 0.000 or minus 0.010 inches in length, 7.040 plus 0.000 or minus 0.010 inches in width and 0.500 plus 0.010 or minus 0.050 inches in thickness. There is a 60° bevel along the axis on the face edge with the 60° angle being formed by the first side and the bevel. All corners are rounded.

The spacing washer has an outer diameter across the flange of about 2.55 inches, an outer diameter across the cylinder of about 1.18 inches, an inner diameter across the cylinder of about 0.96 inches, a length along the cylinder of about 0.37 inches and a thickness of metal in both the cylinder and flange of about 0.12 inches.

The bolts used for attachment can be conventional bolts.

The two-part pedestal liner assembly of the present invention has improved the wear characteristics of the pedestal liner compared to the monolithic pedestal liner casting or the two-part liner assembly of the prior art. The nylon pedestal liner insert acts as a shock absorber on impact, giving way up to 0.060 inch, which reduces impact abrasion of the pedestal liner insert. Impact abrasion is a progressive wearing of the pedestal liner dur to impact chipping or eroding the elastomer surface. When a suitable polyurethane pedestal liner insert is used, the shock absorber action is improved over the nylon, as appropriate polyurethane resins have more resilience than the nylon resins used for the pedestal liner insert. The pedestal liner assemblies of the present invention may be used on either pedestal leg in either of the two possible positions.

The preferred synthetic resinous material for the pedestal liner insert of this invention is nylon, although in some instances other plastic-like materials such as polyacetals, polyurethanes, polyethylenes, and reinforced thermo-setting resins such as phenolics may be used. The nylons and polyurethanes are preferred due to their high strength, low coefficient of friction, non-galling operation and comparative freedom from corrosive attack in environments in which railroads are operated. One suitable nylon is a combination of about eighty percent nylon 66 and about twenty percent of an ionomer. The nylons suitable for pedestal liners have a compressive yield of strength of from about 8,000 to 10,000 pounds per square inch as compounded. For the pedestal liner insert, the polyurethane resin is preferred to nylon.

The nylon and polyurethane resins used in producing the pedestal liner and pedestal liner insert of the present invention are produced from injection molded grades compounded with one or more of the following: conventional copolymers, nucleating agents, stabilizers, lubricants, plasticizers, reinforcements, fillers and flame retardants.

The pedestal liner and pedestal liner insert are readily produced by conventional injection molding techniques. The plurality of holes in the mounting brackets of the pedestal liner for receiving spacing washers through which the means attaching said pedestal liner to the pedestal leg pass are drilled after molding.

In the present invention, the term nylon refers to the higher melting, fiber-forming polyamides. Of the more common of these useful in the practice of this invention may be mentioned polyhexamethylene adipamide (nylon 66), polyhexamethylene sebacamide (nylon 610), polymers prepared from 11-amino undecanoic acid, polymers prepared from higher lactams such as caprylactam and caprolactam (nylon 6), and copolymers, interpolymers and mixtures thereof.

The spacing washers of the present invention may be produced from metals, such as steel, using conventional manufacturing techniques.

It is apparent that the fundamental novel features of the present invention may also be applied in other situations, such as bolster wear plates and journal box wear plates, and for fabricating, either in whole or in part, friction shoes, snubber wedges and journal boxes. In its broadest aspects, this invention contemplates the use of nylon surfaces to accommodate relative movement subject to impact abrasion that takes place between the various component parts of railroad trucks.

While there have been described and pointed out the fundamental novel features of the invention as applied to the preferred embodiment, those skilled in the art will appreciate that various changes, modifications and omissions from the pedestal liner assembly may be made without departing from the spirit of the invention. It is the intention, therefore, to be limited only by the scope of the claims which follow.

What is claimed is:

1. A pedestal assembly for use in a railroad vehicle having a journal box which slides vertically between spaced-apart pedestal legs, said assembly comprising a channel-shaped elastomer structure having an outer wear face oriented to contact a journal box of a railroad truck when said assembly is mounted on a pedestal leg and an inner face enclosed by parallel upstanding flanges of said channel-shaped structure, said upstanding flanges having a plurality of apertures located remotely to said outer wear face, and a plurality of substantially rigid spacing washers, one of said spacing washers received in each aperture, each of said spacing washers having a cylindrical body connected to an annular flange, allowing its cylindrical body to be received in its associated aperture in one of said upstanding flanges so that the annular flange abuts on the outer surface of said upstanding flange so said washer is operable to limit the compression of said elastomer structure due to the length of said cylindrical body member which forms a stop to limit such compression when a mounting bolt forces said spacing washer inwardly against a pedestal leg.

2. The pedestal assembly defined in claim 1 wherein the elastomer is nylon.

3. The pedestal assembly defined in claim 1 wherein the length of the cylindrical body member of each spacing washer is slightly less than the thickness of the associated flange.

4. The pedestal assembly defined in claim 1 wherein said assembly includes a planar rectangular liner element fixedly secured against the inner face of said channel-shaped structure.

5. The pedestal assembly defined in claim 4 wherein the liner element is composed of nylon.

* * * * *